US009212014B2

(12) United States Patent
Masubuchi

(10) Patent No.: US 9,212,014 B2
(45) Date of Patent: Dec. 15, 2015

(54) SHEET FEEDING DEVICE AND PRINTER

(71) Applicant: SEIKO EPSON CORPORATION, Tokyo (JP)

(72) Inventor: Hiroyuki Masubuchi, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/469,558

(22) Filed: Aug. 26, 2014

(65) Prior Publication Data

US 2015/0061213 A1 Mar. 5, 2015

(30) Foreign Application Priority Data

Aug. 27, 2013 (JP) ..... 2013-175338
Aug. 27, 2013 (JP) ..... 2013-175340

(51) Int. Cl.

| | |
|---|---|
| ***B65H 1/08*** | (2006.01) |
| ***B65H 1/14*** | (2006.01) |
| ***B65H 1/26*** | (2006.01) |
| ***B65H 3/06*** | (2006.01) |
| ***B65H 3/52*** | (2006.01) |
| ***B65H 3/56*** | (2006.01) |
| ***B65H 7/00*** | (2006.01) |

(52) U.S. Cl.

CPC .. *B65H 1/08* (2013.01); *B65H 1/14* (2013.01); *B65H 1/266* (2013.01); *B65H 3/0607* (2013.01); *B65H 3/5261* (2013.01); *B65H 3/565* (2013.01); *B65H 7/00* (2013.01); *B65H 2403/422* (2013.01); *B65H 2403/512* (2013.01); *B65H 2404/144* (2013.01); *B65H 2405/1117* (2013.01); *B65H 2405/1134* (2013.01); *B65H 2405/121* (2013.01); *B65H 2511/152* (2013.01); *B65H 2511/212* (2013.01)

(58) Field of Classification Search

CPC ..... B65H 1/04; B65H 1/08; B65H 1/10; B65H 1/12; B65H 1/14; B65H 3/06; B65H 2405/1116; B65H 2405/11162; B65H 2405/1117; B65H 2405/1124; B65H 2405/1134; B65H 5/06; B65H 1/266; B65H 3/0607; B65H 2403/422

See application file for complete search history.

(56) References Cited

U.S. PATENT DOCUMENTS

| | | | | |
|---|---|---|---|---|
| 6,056,285 | A * | 5/2000 | Kikuta et al. | 271/118 |
| 6,443,445 | B1 * | 9/2002 | Bortolotti | 271/117 |
| 2006/0157914 | A1 * | 7/2006 | Suwa | 271/126 |
| 2008/0101837 | A1 * | 5/2008 | Cho | 399/393 |

(Continued)

FOREIGN PATENT DOCUMENTS

| | | | |
|---|---|---|---|
| JP | 5330684 | A | 12/1993 |
| JP | 672570 | A | 3/1994 |
| JP | 8208046 | A | 8/1996 |

(Continued)

*Primary Examiner* — Prasad Gokhale

(74) *Attorney, Agent, or Firm* — Hauptman Ham, LLP

(57) ABSTRACT

The moving mechanism of a sheet feeding device has a first moving member and a second moving member. The first moving member is held in a position corresponding to the number of sheets supported by a sheet support member, and when moving in a specific direction can move the sheet support member in the separation direction away from a paper feed roller. The second moving member moves out and back through a specific range of movement in each revolution of the paper feed roller, engages the first moving member and moves the first moving member in the specific direction when moving out, and releases said engagement when moving back.

9 Claims, 10 Drawing Sheets

(56) References Cited

U.S. PATENT DOCUMENTS

| | | | | |
|---|---|---|---|---|
| 2011/0133397 | A1* | 6/2011 | Shimmachi et al. | 271/265.01 |
| 2013/0241136 | A1* | 9/2013 | Hosohara | 271/18 |

FOREIGN PATENT DOCUMENTS

| | | | |
|---|---|---|---|
| JP | 2006137564 | A | 6/2006 |
| JP | 200940607 | A | 2/2009 |

* cited by examiner

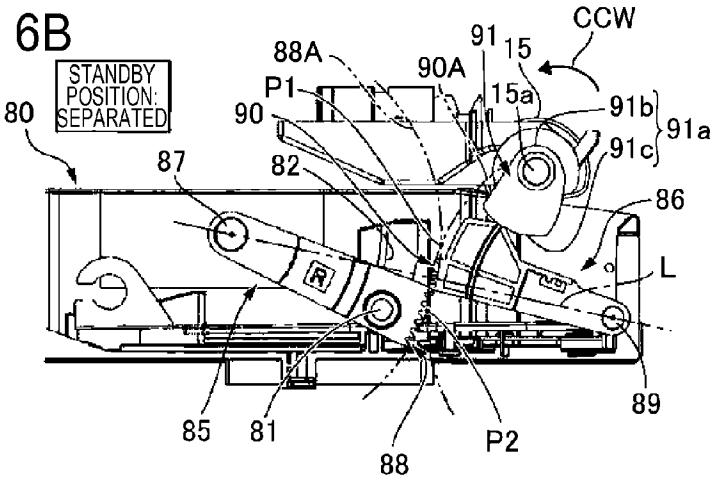
FIG. 6B
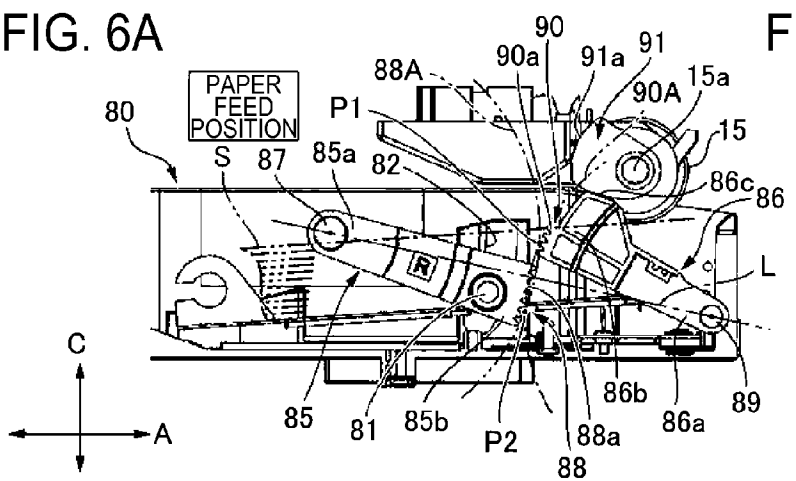
FIG. 6A
FIG. 6D
FIG. 6C

SHEET FEEDING DEVICE AND PRINTER

RELATED APPLICATIONS

Priority is claimed under 35 U.S.C. §119 to Japanese Application Nos. 2013-175338 and 2013-175340 filed on Aug. 27, 2013, which are hereby incorporated by reference in their entirety.

BACKGROUND

1. Technical Field

The present disclosure relates to a sheet feeding device having a mechanism that removes a sheet of media from a feed roller, that feeds sheets of media such as recording paper, and to a printer having the sheet feeding device.

2. Related Art

The inventors have noticed that an example of such a sheet feeding device is the paper supply device of a printer. In this example, recording paper is held in a stack in a cassette and is pressed against a paper supply roller (e.g., a feeding roller). When the paper supply roller turns, the recording paper is fed sequentially from the top sheet in the stack to the paper feed path inside the printer. The sheet support member that supports the stacked recording paper in the cassette is called a hopper plate, for example. The hopper plate is pushed toward the paper feed roller by a spring member, and the stacked recording paper is pressed against the paper feed roller regardless of the number of sheets in the stack.

The inventors have noticed an operation that separates recording paper from the paper feed roller may also be performed in this paper supply device. In this event, the hopper plate is forcibly pushed in the direction away from the paper supply roller after the recording paper is advanced a specific amount and passed to a downstream separating mechanism. The recording paper feeding operation and the operation separating the recording paper from the paper feed roller are executed alternately each time the paper feed roller turns one revolution. JP-A-2006-137564 discloses a sheet feeding device that alternately performs a feeding operation and a separating operation.

The inventors have noticed that a sheet feeding device disclosed in JP-A-2006-137564 has a depressing mechanism that pushes a middle plate (hopper plate) down. The rotation of a paper feed cam that rotates in conjunction with the paper feed roller in this mechanism pushes a depressing arm down pivoting on a pivot point. When the depressing arm is pushed down, a depressing claw inside the depressing arm extends straight out, and engages a middle plate claw disposed on the middle plate side. The middle plate is then also pushed down when the depressing arm descends, and the sheets stacked on the middle plate separate from the paper feed roller. Because the depressing claw extends through a wide range in the sheet stacking direction, the depressing claw can be engaged with the middle plate claw even when the position of the middle plate changes according to the number of stacked sheets.

For example, the inventors have noticed that the depressing mechanism disclosed in JP-A-2006-137564 has a depressing claw that can slide in a straight line in the depressing arm that pivots with rotation of a paper feed cam. The mechanism for moving the depressing claw in and out in conjunction with the depressing action of the depressing arm is also disposed between the depressing arm and the depressing claw.

SUMMARY

According to some embodiments, a sheet feeding device comprises a paper feed roller, a sheet support member which supports a sheet of recording media supplied by the paper feed roller, and a moving mechanism for moving the sheet support member in a separation direction away from the paper feed roller. The moving mechanism includes a first moving member and a second moving member. The first moving member is held in a position corresponding to the number of sheets by the sheet support member, and when the first moving member moves in a particular direction, the sheet member can be moved in the separation direction. The second moving member is configured to move out and back through a specific range of movement for each revolution of the paper feed roller, and is configured to also engage the first moving member and move the first moving member in the specific direction upon moving out, and to release the engagement when moving back.

According to at least one embodiment, a printer comprises a paper supply device, and a printhead configured to print on recording media supplied from the paper supply device. The paper supply device is a sheet feeding device, including a paper feed roller, a sheet support member configured to support a number of sheets of recording media supplied by the paper feed roller, and a moving mechanism configured to move the sheet support member in a separation direction away from the paper feed roller according to rotation of the paper feed roller. The moving mechanism comprises a first moving member configured to be held in a position corresponding to the number of sheets supported by the sheet support member, and upon moving in a specific direction, the first moving member moves the sheet support member in the separation direction. The moving mechanism also has a second moving member configured to move out and back through a specific range of movement in each revolution of the paper feed roller, and engage the first moving member and move the first moving member in the specific direction upon moving out, and to release the engagement upon moving back.

BRIEF DESCRIPTION OF THE DRAWINGS

FIGS. 6A-6D are views of the hopper plate moving mechanism.

DESCRIPTION OF EMBODIMENTS

An exemplary embodiment of the present disclosure is described below. This embodiment describes an example of an inkjet printer that has a paper supply device. The embodiment is also applicable to printers other than inkjet printers. The embodiment is also not limited to paper supply devices for supplying recording paper, and can be applied to sheet feeding devices that feed checks, tickets, and other type of sheet media, and to sheet processing devices having the sheet feeding device.

Figure 1:
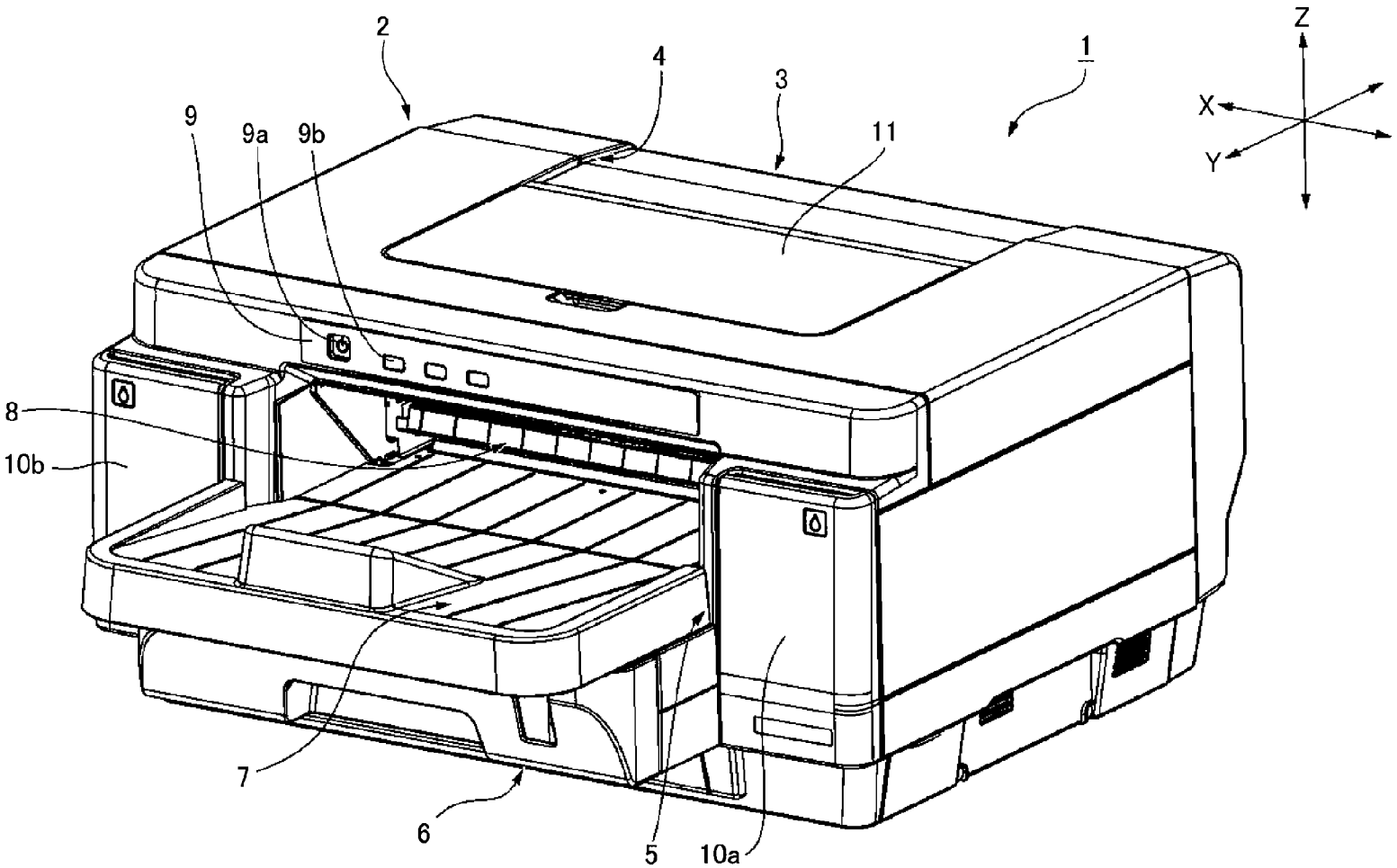
FIG. 1 is an oblique front view of an inkjet printer according to at least one embodiment.
Figure 2:
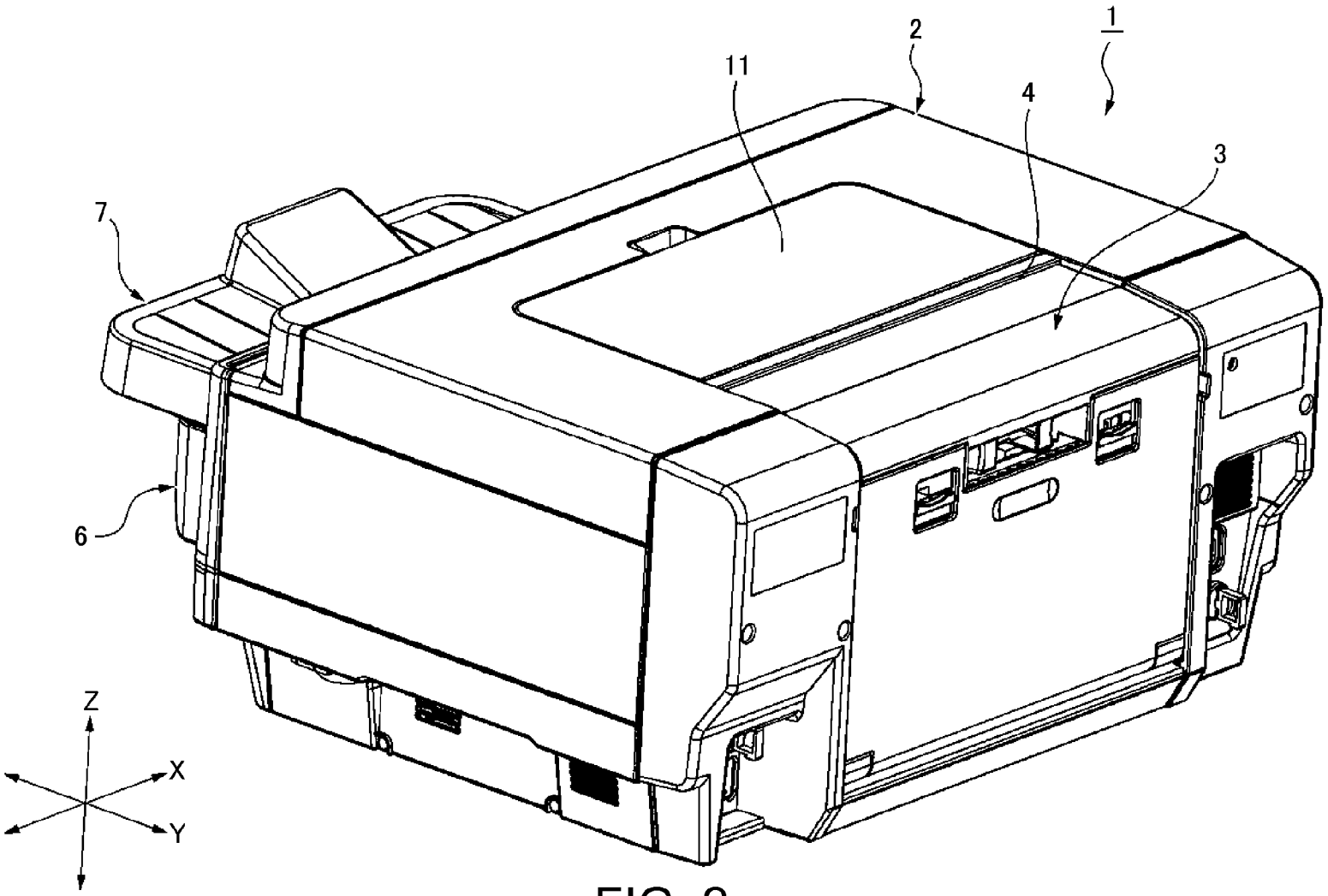
FIG. 2 is an oblique view of the inkjet printer of FIG. 1.
Figure 3A:
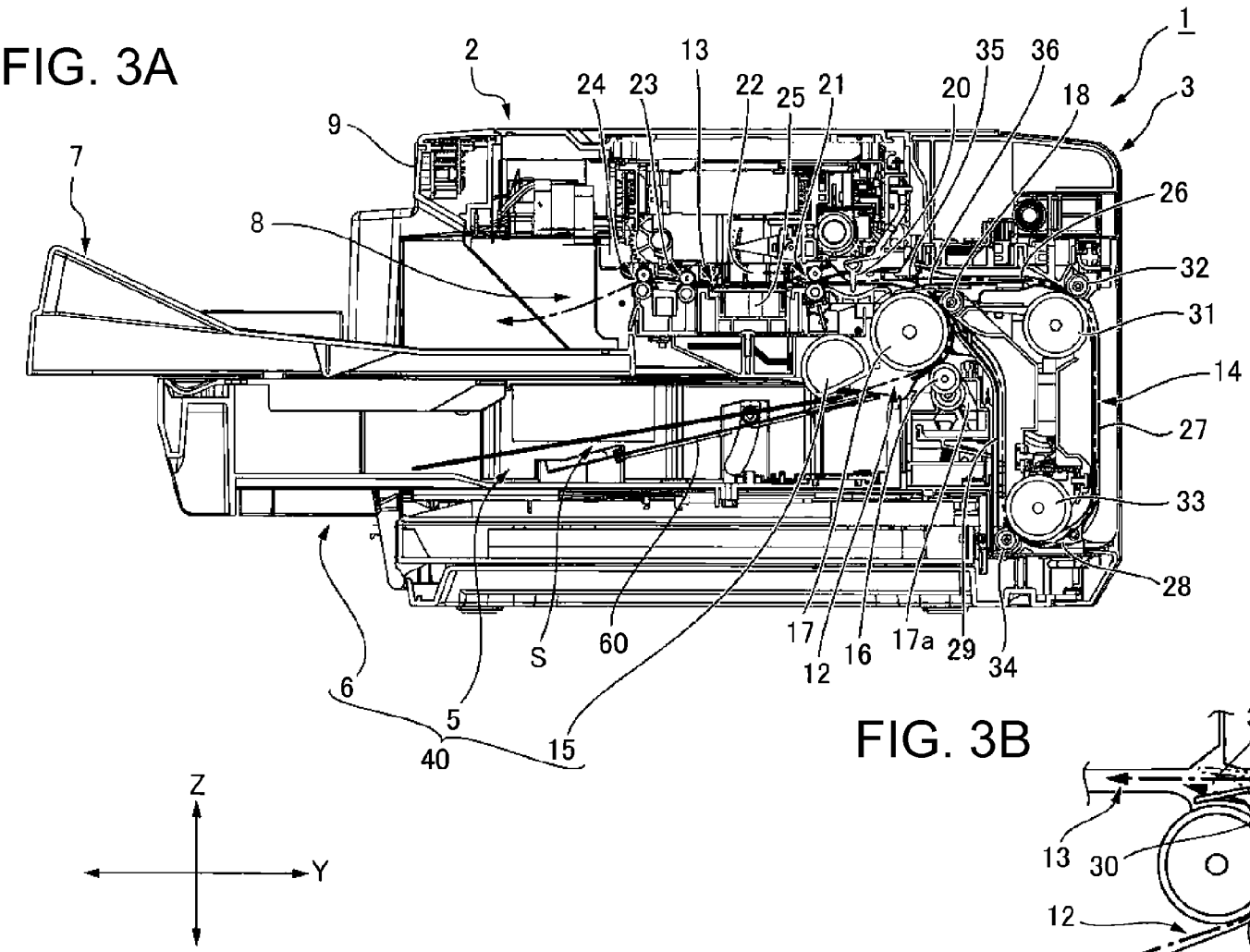
FIG. 3A is a vertical section view and FIG. 3B is an enlarged view of part of the internal configuration of the inkjet printer of FIG. 1.
Figure 3B:
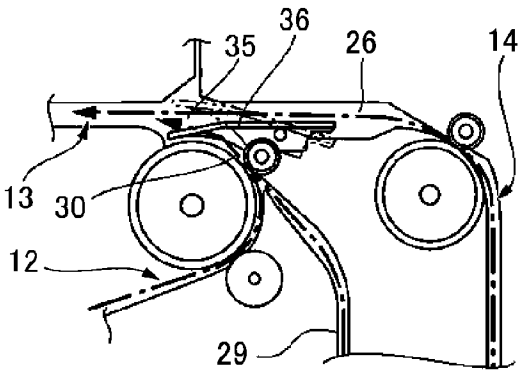

FIG. 1 is an external oblique view from the front of an inkjet printer ("printer" below) according to at least one embodiment, and FIG. 2 is an external oblique view of the printer from the back. FIG. 3A is a vertical section view and FIG. 3B is a partial section view of the internal configuration of the printer.

As shown in FIG. 1 and FIG. 2, the printer 1 has a printer cabinet 2 and a inverting unit 3. The printer cabinet 2 is a basically rectangular box-like shape that is long on the transverse axis X widthwise to the printer. A recess 4 is formed in the middle of the printer cabinet 2, near the back. The inverting unit 3 is installed in this recess 4. The inverting unit 3 is a unit for inverting the front and back sides of the printing paper ("paper"), which is a form of sheet media, and then returning the inverted paper into the printer cabinet 2. The inverting unit 3 can open to the back on the longitudinal axis Y of the printer pivoting at the bottom on the vertical axis Z of the printer.

A paper cassette loading unit 5 (sheet cassette loading unit) is disposed to the front of the printer cabinet 2. The paper cassette loading unit 5 opens to the front on the longitudinal printer axis Y at a position toward the bottom on the vertical printer axis Z in the front of the printer cabinet 2. A paper cassette 6 (sheet storage cassette) can be loaded from the front into the paper cassette loading unit 5. A paper discharge tray 7 is attached at the top of the paper cassette loading unit 5. The paper discharge tray 7 extends horizontally to the front. A rectangular paper exit 8 extending toward the back of the printer is formed at the top of the paper discharge tray 7.

An operating panel 9 is at the front of the printer above the paper exit 8. The operating panel 9 includes a power switch 9*a* and a plurality of state indicators 9*b*. Rectangular access doors 10*a*, 10*b* are attached to the front of the printer on opposite sides of the paper discharge tray 7 and paper exit 8. When the access doors 10*a*, 10*b* are open, the ink cartridge loading unit (not shown in the figure) opens and the ink cartridges (not shown in the figure) can be replaced.

The top of the printer is substantially flat, and has an access cover 11 attached in the middle for maintenance.

Internal Configuration of the Printer

The internal configuration of the printer 1, and particularly the paper conveyance path, is described next with reference to FIGS. 3A and 3B. A paper supply path 12, main conveyance path 13, and inverting conveyance path 14 are formed inside the printer 1. The paper supply path 12 and main conveyance path 13 are formed inside the printer cabinet 2, and the inverting conveyance path 14 is formed inside the inverting unit 3.

The paper supply path 12 is a conveyance path that conveys paper S of a specific size stored in a stack in the paper cassette 6 to the main conveyance path 13. The paper supply path 12 extends diagonally up from the back end of the paper cassette loading unit 5 on the longitudinal printer axis Y, curves toward the front, and connects to the main conveyance path 13. Paper S stored in the paper cassette 6 is pressed against the paper feed roller 15 (feed roller) by a hopper plate 60 (sheet support member). When the paper feed roller 15 then turns, the paper S is fed into the paper supply path 12.

The supplied paper S is fed one sheet at a time through the nipping part of a conveyance roller 17 and a retard roller 16, which is also called a separation roller. The paper S fed through the nipping part of the retard roller 16 and conveyance roller 17 is then conveyed to the main conveyance path 13 through the nipping part of the conveyance roller 17 and a follower roller 18.

After being separated and conveyed by the retard roller 16, the paper S separates from the conveyance roller 17 opposite the retard roller 16. A lever 17*a* protrudes into the paper supply path 12 in conjunction with the operation separating the retard roller 16 from the conveyance roller 17.

The lever 17*a* moves in the direction pushing the paper back to the paper cassette 6 side. If paper remains at the retard roller 16, that paper is pushed back by the lever 17*a*.

Before the media return operation of the lever 17*a*, the hopper plate 60 is moved in the direction separating from the paper feed roller 15 by a hopper plate moving mechanism 80 (see FIG. 6) described below, and the paper stored on the hopper plate 60 separates from the paper feed roller 15. This enables the lever 17*a* to push the paper back to the paper cassette 6 side. The operation of feeding the paper S from the paper cassette 6, and the operation of separating the paper from the paper feed roller 15, are executed alternately in one revolution of the paper feed roller 15.

The main conveyance path 13 is the conveyance path extending substantially horizontally along the longitudinal printer axis Y to the paper exit 8. Disposed along the main conveyance path 13 from the upstream side in the paper conveyance direction are a paper detection lever 20, a paper feed roller pair 21, a printhead 22, a first discharge roller pair 23, and a second discharge roller pair 24. The printhead 22 is an inkjet head, and a platen 25 is disposed opposite the nozzle face with a specific gap therebetween.

Paper S fed from the paper supply path 12 to the main conveyance path 13 is conveyed by the conveyance roller 17 to the paper feed roller pair 21 while pushing up on the paper detection lever 20. The paper S fed into the paper feed roller pair 21 is conveyed passed the printing position of the printhead 22 by the paper feed roller pair 21 toward the first discharge roller pair 23. The paper S fed to the first discharge roller pair 23 passes the first discharge roller pair 23 and second discharge roller pair 24, and is discharged from the paper exit 8 onto the paper discharge tray 7.

The inverting conveyance path 14 formed inside the inverting unit 3 is located below the main conveyance path 13 on the vertical printer axis Z, and is a conveyance path that generally forms a loop. The inverting conveyance path 14 includes an upstream path 26 that connects to the upstream end of the main conveyance path 13 and extends substantially horizontally to the back on the longitudinal printer axis Y, a descending path 27 that curves and extends down in a straight line on the vertical printer axis Z from the upstream path 26, a bottom path 28 that connects to the descending path 27 and curves to the front on the longitudinal printer axis Y, and an ascending path 29 that curves and extends upward from the bottom path 28.

The top part of the ascending path 29 curves at an angle to the printer front, and merges with the paper supply path 12 in the middle. More specifically, ascending path 29 and the downstream part of the paper supply path 12 form a common path 30. This common path 30 is a curved path extending along the outside of the paper conveyance roller 17.

A first conveyance roller 31 and a follower roller 32 are disposed between the upstream path 26 and the descending path 27, and a second conveyance roller 33 and a follower roller 34 are disposed between the bottom path 28 and the ascending path 29. Paper S conveyed from the main conveyance path 13 to the inverting conveyance path 14 is nipped by the first conveyance roller 31 and follower roller 32, then conveyed by the first conveyance roller 31 to the nipping part of the second conveyance roller 33 and follower roller 34, and then conveyed by the second conveyance roller 33 to the nipping part of the conveyance roller 17 and follower roller 18. The paper S is then fed by the conveyance roller 17 to the main conveyance path 13 again.

By passing through the loop of this inverting conveyance path 14, the paper S is reversed front and back and returned to the main conveyance path 13. Printing on both sides of the paper S is therefore enabled by conveying the paper through the inverting conveyance path 14.

A path-changing flapper 36 is disposed at the junction 35 of the upstream end of the main conveyance path 13, the upstream end of the inverting conveyance path 14, and the downstream end of the common path 30. The path-changing flapper 36 can pivot up and down on the vertical printer axis Z at the back end of the flapper 36 on the longitudinal printer axis Y. The path-changing flapper 36 is normally held by its own weight in a first switched position with the main part of the flat at the front on the longitudinal printer axis Y resting on the outside of the conveyance roller 17.

Paper back-fed from the main conveyance path 13 side from this state is guided by the path-changing flapper 36 to the inverting conveyance path 14 side. The paper then passes through the inverting conveyance path 14 and returns to the junction 35. The path-changing flapper 36 is pushed up by the paper returning to the junction 35, and can move from the first switched position to a second switched position. When the path-changing flapper 36 is pushed up to the second switched position, the common path 30 from the downstream end of the inverting conveyance path 14 communicates with the main conveyance path 13. The paper is therefore conveyed into the main conveyance path 13 while pushing the path-changing flapper 36 up. After the paper passes, the path-changing flapper 36 returns by its own weight to the first switched position.

The path-changing flapper 36 is also pushed up by the paper fed from the paper supply path 12 to the main conveyance path 13 when paper is supplied from the paper cassette 6. After the paper passes, the path-changing flapper 36 returns of its own weight to the first switched position. Paper back-fed from the main conveyance path 13 will therefore not go through the common path 30 to the inverting conveyance path 14 or the paper supply path 12. The paper path can also be changed by a simple configuration without using a separate source of drive power or urging member, for example.

Paper Supply Device

Figure 4B:
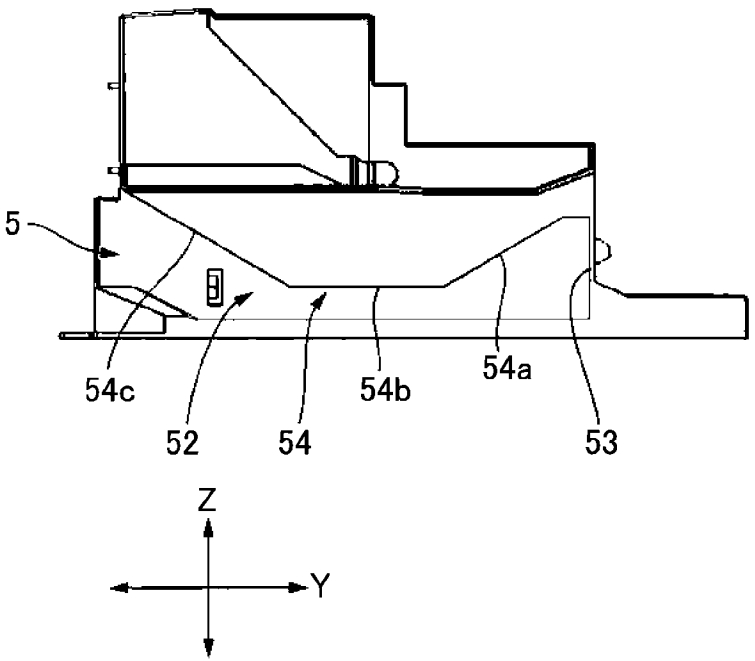
FIG. 4A is an oblique view and FIG. 4B is a schematic view of the cassette loading unit.
Figure 4A:
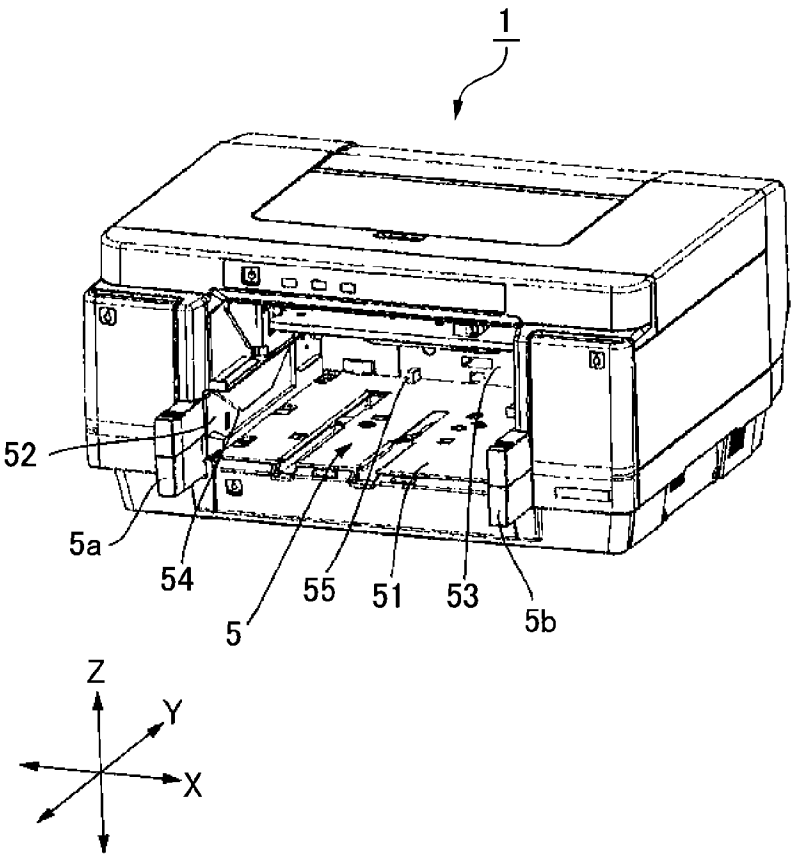
Figure 5B:
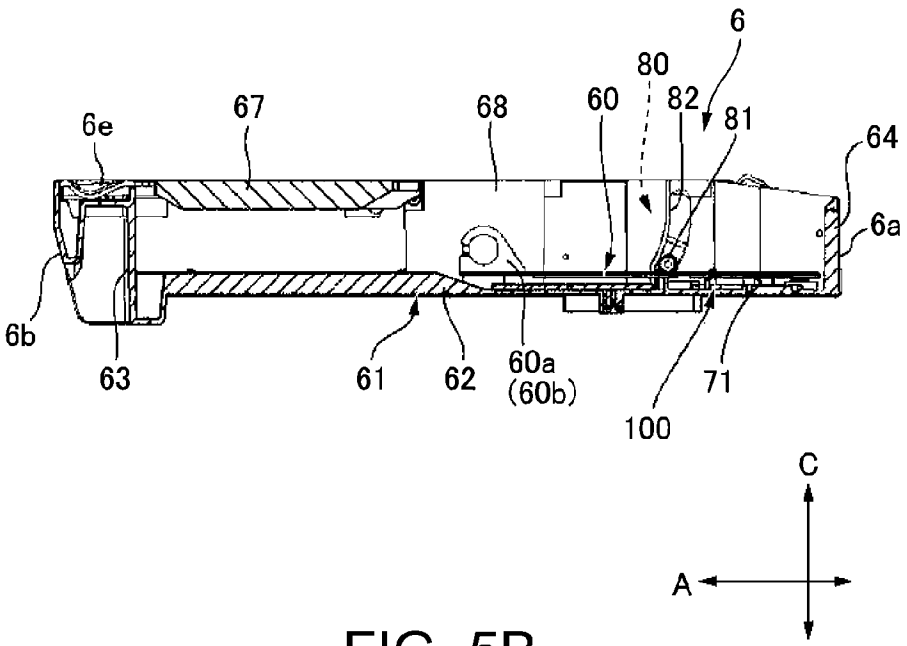
FIG. 5A is an oblique view and FIG. 5B is a vertical section view of the paper supply cassette.
Figure 5A:
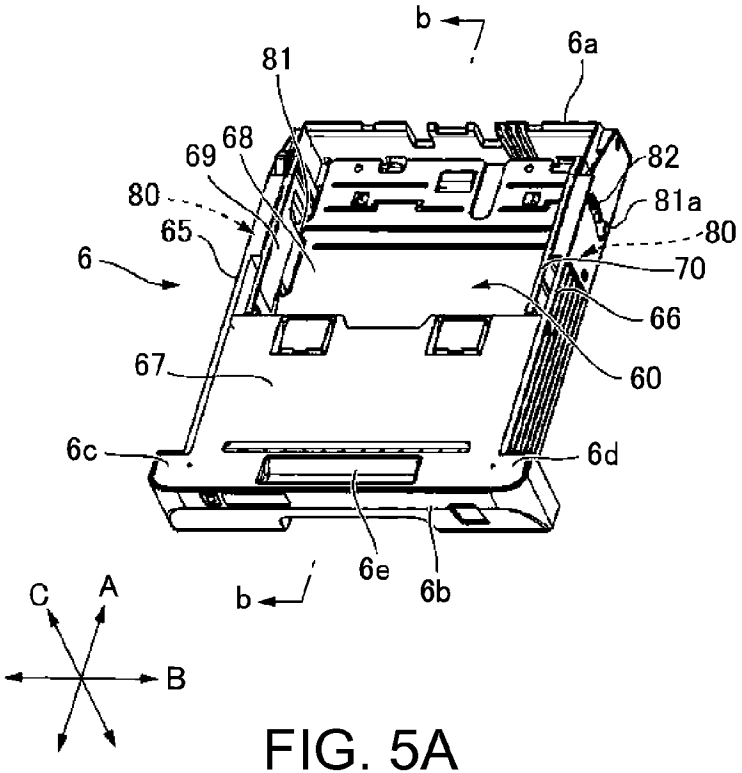

As shown in FIG. 3A, the paper supply device 40 that supplies paper S in this printer 1 includes the paper cassette loading unit 5, paper feed roller 15, and paper cassette 6. FIG. 4A is an external oblique view from the front of the printer, and shows the printer 1 without the paper cassette 6 so that the paper cassette loading unit 5 can be seen more clearly. FIG. 4B is a side view illustrating the inside of the paper cassette loading unit 5. FIG. 5A is an oblique view, and FIG. 5B is a section view, of the paper cassette 6.

Referring primarily to FIG. 4 and FIG. 5, the paper cassette 6 has a generally flat, box-like configuration, and the paper cassette loading unit 5 in the printer 1 is a cavity that opens to the front on the longitudinal printer axis Y and recedes to the back of the printer. The paper cassette 6 can be installed and removed from the paper cassette loading unit 5 on the longitudinal printer axis Y. More specifically, the paper cassette 6 can be loaded from the side at the back end 6*a* thereof on the longitudinal axis to the paper cassette loading unit 5.

When the paper cassette 6 is installed in the paper cassette loading unit 5, the flanges 6*c*, 6*d* that protrude from the left and right sides at the front end 6*b* of the paper cassette 6 stop against the arms 5*a*, 5*b* on the paper cassette loading unit 5 side, thereby controlling the installation position of the paper cassette 6. The paper cassette 6 installed in the paper cassette loading unit 5 can be removed by holding and pulling out on the grip 6*e* formed at the front end 6*b* on the longitudinal axis.

Note that as necessary in the following description, the direction of the long side of the paper cassette 6 is referred to as the longitudinal cassette axis A, the short side as the transverse cassette axis B, and the height as the vertical cassette axis C. When the paper cassette 6 is installed in the paper cassette loading unit 5, the longitudinal cassette axis A is substantially aligned with the longitudinal printer axis Y of the printer, the transverse cassette axis B is substantially aligned with the transverse axis X of the printer, and the vertical cassette axis C is substantially aligned with the vertical printer axis Z of the printer.

As shown in FIG. 5A, the paper cassette 6 has a cassette body 61 that is generally shaped like a flat box. The cassette body 61 includes a rectangular bottom panel 62, and a front wall 63, back wall 64, and left and right side walls 65, 66 that rise substantially perpendicularly from the four edges of the front wall bottom panel 62. A cover 67 covers the top of the cassette body 61 from the front wall 63 partway to the back wall 64. The area from the back end of the top cover 67 to the back wall 64 is an opening 68. The sides of the opening 68 are defined by left and right side members 69, 70 disposed respectively on the inside sides of the left and right side walls 65, 66. A rectangular hopper plate 60 (sheet support member) is disposed to the bottom panel 62 in the area partially surrounded by the side members 69, 70 and the back wall 64. The paper is stored in a stack on the hopper plate 60.

Pivot parts 60*a*, 60*b* are formed on the left and right sides of the end of the hopper plate 60 on the front wall 63 side. These pivot parts 60*a*, 60*b* can rotate on the vertical cassette axis C on a support pin not shown relative to the inside left and right side members 69, 70. A spring 71 is disposed in a compressed state as a pressure member between the hopper plate 60 and the bottom panel 62, and this spring 71 constantly pushes the hopper plate 60 in the direction away from the bottom panel 62. When the hopper plate 60 is pushed up on the vertical cassette axis C, the paper S stacked on the hopper plate 60 is pressed against the paper feed roller 15 on the paper cassette loading unit 5 side. This position is shown in FIG. 6 (*a*). When the paper feed roller 15 then rotates in this state, the paper S is fed from the paper cassette 6 to the paper supply path 12 (FIG. 3).

A hopper plate moving mechanism 80 is respectively disposed between the left and right side walls 65, 66, and the left and right side members 69, 70. The hopper plate moving mechanisms 80 work to push the hopper plate 60 in the direction away from (down on the vertical cassette axis C) the paper feed roller 15 according to the rotational position of the paper feed roller 15. The left and right hopper plate moving mechanisms 80 are identically configured and symmetrically disposed, and the same reference numerals are used for the identical corresponding parts thereof.

The hopper plate moving mechanisms 80 each have an engaging pin 81. The engaging pins 81 are engaging parts that protrude to the inside from the left and right inside side members 69, 70 and engage the hopper plate 60. The engaging pins 81 rest on the top of the hopper plate 60. More specifically, the engaging pins 81 engage the hopper plate 60 from the paper feed roller 15 side. The engaging pins 81 pass through and can slide in pin guide holes 82 formed in the left and right outside side walls 65, 66. The pin guide holes 82 are curved slots of a constant width, and the range of engaging pin 81 movement is limited by the pin guide hole 82.

A locking mechanism 100 that locks and prevents the hopper plate 60 from moving is assembled to the bottom panel 62 near the back wall 64. The hopper plate 60 is locked by the locking mechanism 100 at the position of hopper plate 60 movement closest to the bottom panel 62 and farthest from the paper feed roller 15, that is, at the locked position shown in FIG. 5B.

Because the paper cassette loading unit 5 is also configured left-right symmetrical, identical parts on the left and right sides are identified by the same reference numerals. As shown in FIG. 4, the paper cassette loading unit 5 has a floor panel 51 that guides the paper cassette 6, and cassette guides 52 on the left and right. An end panel 53 that can contact the back end 6*a* of the paper cassette 6 is disposed to the paper cassette loading unit 5 at the inside end in the insertion direction of the paper cassette 6. A cam rail 54 (loading unit-side engaging parts) of a constant width that faces down is formed on the left and right cassette guides 52 as shown in FIG. 4B.

As shown in FIG. 5A, the distal ends of the left and right engaging pins 81 of the paper cassette 6 protrude to the outside from the curved pin guide holes 82 formed in the left and right outside side walls 65, 66. The outside protruding parts 81*a* of the engaging pins 81 engage the cam rail 54 from below. When the paper cassette 6 is pulled out from the paper cassette loading unit 5, the engaging pins 81 are pushed down by the cam rails 54, and the hopper plate 60 engaged by the engaging pins 81 is pushed down to the locking position by the locking mechanism 100 and locked.

Unlocking keys 55 (lock release member) are disposed to the inside end panel 53 of the paper cassette loading unit 5 at left and right symmetrical positions as shown in FIG. 4A. When the paper cassette 6 is installed in the paper cassette loading unit 5, the unlocking keys 55 engage the locking mechanism 100, and the hopper plate 60 is released from being locked by the locking mechanism 100. The construction of these parts is further described below.

Hopper Plate Moving Mechanism

FIG. 6 shows the configuration of the hopper plate moving mechanism 80. FIG. 6A shows when there is a large number of sheets on the hopper plate 60 during the paper supply operation, and FIG. 6B shows when a large number of sheets is stored and the hopper plate is in the position separated from the paper feed roller 15. FIG. 6C shows when only a few sheets are on the hopper plate 60 during the paper supply operation, and FIG. 6B shows when only a few sheets are stored and the hopper plate is in the position separated from the paper feed roller 15.

Configuration of the Hopper Plate Moving Mechanism

The hopper plate moving mechanism 80 assembled on the right side between the side walls 65, 70 of the paper cassette 6 is described next. The hopper plate moving mechanism 80 has a first pivot plate 85 as a first moving member, and a second pivot plate 86 as a second moving member. The first and second pivot plates 85, 86 are disposed in line with the direction in which the paper S is fed by the paper feed roller 15, and are disposed in mutual opposition from the upstream and downstream sides in the paper feed direction. In this example the paper feed direction is on the longitudinal cassette axis A, that is, the direction in which the paper cassette 6 is installed and removed. The first pivot plate 85 is located on the front side on the longitudinal cassette axis A, and the second pivot plate 86 is on the back side.

The back end 85*a* of the first pivot plate 85 located at the far end from the second pivot plate 86 is supported pivotably by a first support pin 87 fixed between the side walls 66, 70. The first pivot plate 85 can pivot on the first support pin 87 up and down on the vertical cassette axis C. A first external engagement gear 88 is formed as a first engaging part on the curved end face of the distal end part 85*b* of the first pivot plate 85 on the end closest to the second pivot plate 86. The first external engagement gear 88 has a plurality of first external teeth 88*a* formed at a uniform pitch through a specific angular range along the curved end face of which the center point is the first support pin 87.

An engaging pin 81 is affixed to the distal end part 85*b* of the first pivot plate 85. As described above, the engaging pin 81 can slide in the pin guide holes 82 formed in the side wall 66. The inside end of the engaging pin 81 rides on the top of the hopper plate 60. The engaging pin 81 is positioned approximately in the center between the pivot point and the free distal end of the hopper plate 60. The engaging pin 81 and the hopper plate 60 are held engaged by the weight of the first pivot plate 85.

The first pivot plate 85 is therefore held in a relative rotational position corresponding to the position of the hopper plate 60. In other words, the hopper plate 60 moves toward and away from the paper feed roller 15 according to the number of sheets (the amount of sheets) stored on the hopper plate 60. The first pivot plate 85 engaging the hopper plate 60 is held in a rotational position corresponding to the number of sheets on the hopper plate 60. When the first pivot plate 85 rotates to the bottom panel 62 side of the paper cassette 6, the hopper plate 60 is depressed in the same direction in resistance to the spring force of the spring 71.

The back end part 86*a* at the far end of the second pivot plate 86 from the first pivot plate 85 is pivotably supported by a second support pin 89 disposed between the side walls 66, 70. The second pivot plate 86 can pivot on the vertical cassette axis C on the second support pin 89. The second pivot plate 86 is constantly pushed up by a spring member (not shown in the figure) disposed to the second support pin 89. A second external engagement gear 90 is formed as a second engaging part in unison with the curved distal end of the distal end part 86*b* of the second pivot plate 86 near the first pivot plate 85. The second external engagement gear 90 is a gear having second external teeth 90*a* that can mesh with the first external teeth 88*a* formed at a specific pitch through a specific angular range on a curved end face centered on the second support pin 89.

The hopper plate moving mechanism 80 has a cam plate 91 on the paper cassette loading unit 5 side. The cam plate 91 is fastened to the end of the roller shaft 15*a* of the paper feed roller 15, and extends in a direction perpendicular to the roller shaft 15*a*. The outside surface of a specific width of the cam plate 91 is the cam surface 91*a*. When the paper cassette 6 is installed in the paper cassette loading unit 5, as shown in FIG. 6, the cam plate 91 is positioned above the second pivot plate 86 on the vertical cassette axis C (the vertical printer axis Z of the printer). The second pivot plate 86 is pushed up by a spring member not shown. A cam follower 86*c* that is pressed against the cam surface 91*a* is formed on the top end face of the second pivot plate 86 at a position opposing the cam plate 91. When the paper cassette 6 is installed in the paper cassette loading unit 5, the cam follower 86*c* of the second pivot plate 86 is pressed against the cam surface 91*a* of the cam plate 91, and the second pivot plate 86 is thus engaged with the cam plate 91.

The second pivot plate 86 rotates on the second support pin 89 on the vertical cassette axis C (vertical printer axis Z) as a result of the cam surface 91*a* of the cam plate 91 that rotates in unison with the paper feed roller 15. More specifically, the second pivot plate 86 turns according to rotation of the paper feed roller 15. The second pivot plate 86 is set to the highest position, the first position, when the cam follower 86*c* is on the paper supply cam surface portion 91*b* where the rotational radius of the cam surface 91*a* from the axis of rotation is shortest. When the cam follower 86*c* is on the separation cam surface portion 91*c* where the rotational radius of the cam surface 91*a* is long, the second pivot plate 86 is pushed down. When the cam follower 86*c* is on the cam surface where the rotational radius is long, the second pivot plate 86 is pushed down to a second position at the lowest position shown in FIG. 6B and FIG. 6D. Each time the paper feed roller 15 turns one revolution, the second pivot plate 86 moves one round trip between the first position and the second position.

The first external engagement gear 88 formed on the first pivot plate 85, and the second external engagement gear 90 formed on the second pivot plate 86, are disposed so that they can mesh together. More specifically, these gears are disposed in mutual opposition with circumscribed pitch circles, and can mesh at the circumscribed position on line L through the first support pin 87 and the second support pin 89. When the second pivot plate 86 is rotated to the second position shown in FIG. 6B and FIG. 6D, substantially the center of the second external engagement gear 90 in the circumferential direction is at the meshed position (is positioned on line L).

The addendum circles 88A, 90A of the first and second external engagement gears 88, 90 that mesh on line L intersect through a specific angular range centered on the meshing position (the position on line L). The range of intersection from point of intersection P1 to point of intersection P2 is the range through which the first and second external engagement gears 88, 90 can engage. Therefore, when the second external engagement gear 90 rotates in the direction from the first position to the second position, the first external teeth 88*a* of the first external engagement gear 88 positioned in the range of intersection of the addendum circle are at the start-meshing position. This state of engagement is held until the second pivot plate 86 rotates to the second position (FIG. 6B, FIG. 6D).

The position of the first pivot plate 85 changes on the vertical cassette axis C together with the hopper plate 60. More specifically, when many sheets of paper S are on the hopper plate 60, the first pivot plate 85 is rotated to the bottom panel 62 side and positioned to a lower position as shown in FIG. 6A. When few sheets of paper S are loaded, the first pivot plate 85 is at a raised position separated from the bottom panel 62 as shown in FIG. 6C.

The angular range through which the external teeth of the first external engagement gear 88 are formed is set so that the first pivot plate 85 can be rotated down by the second pivot plate 86 wherever the first pivot plate 85 is positioned in the range of rotation. More specifically, the angular range of the first external teeth 88*a* is set so that the one of the first external teeth 88*a* of the first external engagement gear 88 is always in the range of intersection of the addendum circles of the first and second external teeth 88*a*, 90*a* (the range from point P1 to point P2). Note that the second external engagement gear 90 basically only needs one second external tooth 90*a*. The gears can be kept reliably and stably meshed by forming a plurality of second external teeth 90*a* through a specific angular range.

When the maximum number of sheets are loaded as shown in FIG. 6A, the first external engagement gear 88 of the first pivot plate 85 is in the down position separated from the second external engagement gear 90 of the second pivot plate 86. In this event, the top first external tooth 88*a* of the first external engagement gear 88 is in the range of intersection between point P1 and point P2. When only one sheet of paper is loaded as shown in FIG. 6C (or there is no paper), the first external tooth 88*a* at the bottom end of the first external engagement gear 88 is in the range of intersection between point P1 and point P2.

Therefore, wherever the first pivot plate 85 is positioned, the second pivot plate 86 can mesh with the first pivot plate 85 at some point when the second pivot plate 86 pivots from the first position to the second position. As a result, when the second pivot plate 86 pivots a specific angle from the first position, the second pivot plate 86 meshes with the first pivot plate 85 regardless of where the first pivot plate 85 is positioned, that is, regardless of how much paper is loaded on the hopper plate 60.

The second pivot plate 86 pivots to the second position after engaging the first pivot plate 85. As a result, the first pivot plate 85 also pivots, and the hopper plate 60 engaged by the first pivot plate 85 moves a specific amount in the separation direction. Regardless of how much paper is loaded on the hopper plate 60, the hopper plate 60 can therefore be reliably moved and the paper S can be reliably separated from the paper feed roller 15 within a specific angular range in one revolution of the paper feed roller 15.

Operation of the Hopper Plate Moving Mechanism

Before the paper S supply operation starts, the cam plate 91 attached to the paper feed roller 15 is in the standby rotational position shown in FIG. 6B and FIG. 6D. In this state, the second pivot plate 86 is pushed down to the lower second position by the cam plate 91. The bottom second external tooth 90*a* in the second external engagement gear 90 of the second pivot plate 86 meshes with the top first external tooth 88*a* of the first external engagement gear 88 of the first pivot plate 85, and the first pivot plate 85 is pushed down. The hopper plate 60 is therefore also pushed down by the first pivot plate 85, and the paper S stacked on the hopper plate 60 is separated a specific distance below the paper feed roller 15.

When the paper feed roller 15 then rotates in the paper supply direction indicated by arrow CCW, the separation cam surface portion 91*c* of the cam surface 91*a* of the cam plate 91 rides past the cam follower 86*c* of the second pivot plate 86 and the second pivot plate 86 returns to the up first position due to the force of the spring. Because the downward pressure on the second pivot plate 86 is removed, the first pivot plate 85 and the hopper plate 60 engaged therewith are pushed up again by the force of the spring 71. As a result, the paper S on the hopper plate 60 is pressed against the paper feed roller 15, and can be supplied to the conveyance path. The top sheet of paper S is thereafter fed from the stack in the paper cassette 6 to the paper supply path 12 in conjunction with rotation of the paper feed roller 15. FIG. 6A and FIG. 6C show during the paper supply (delivery) operation.

When the paper feed roller 15 rotates until the paper S is advanced a specific distance, the paper supply cam surface portion 91*b* of the cam plate 91 passes the cam follower 86*c*, and the separation cam surface portion 91*c* again contacts the cam follower 86*c* of the second pivot plate 86 and pushes the second pivot plate 86 down. The second pivot plate 86 is pushed from the first position at the highest point toward the second position at the lowest point. When the second pivot plate 86 rotates a specific angle toward the second position shown in FIG. 6B and FIG. 6D, the second external engagement gear 90 meshes with the first external engagement gear 88 of the first pivot plate 85. Thereafter, the first pivot plate 85 is pushed down a specific amount by the second pivot plate 86 rotating to the second position, and the hopper plate 60 is also pushed down a specific amount. As a result, the paper S is separated from the paper feed roller 15 as shown in FIG. 6B and FIG. 6D.

When there is substantially no paper S as shown in FIG. 6C, the hopper plate 60 is pushed up, and the first pivot plate 85 is thereby also held in the up rotational position (relative rotational position). When the second pivot plate 86 pivots from the first position to the second position, it immediately meshes with the first pivot plate 85 after pivoting only slightly. While rotating to the second position, the first pivot plate 85 is pushed down a specific amount and separates from the paper feed roller 15.

In contrast, when many sheets of paper S are loaded as shown in FIG. 6A, the hopper plate 60 is pushed down and the first pivot plate 85 is accordingly held at the rotational position (relative rotational position) separated down from the second pivot plate 86. In this event, the second pivot plate 86 engages the first pivot plate 85 after pivoting a specific amount from the first position toward the second position. Rotation of the first pivot plate 85 when moving while pivoting to the second position is therefore slight.

Therefore, when there is little paper, rotation of the first pivot plate 85 by the second pivot plate 86 increases, and movement of the hopper plate 60 increases. Conversely, when there are many sheets of paper, rotation of the first pivot plate 85 by the second pivot plate 86 decreases, and movement of the hopper plate 60 decreases.

In either case, when the second pivot plate 86 pivots a specific angle toward the second position, the second pivot plate 86 engages the first pivot plate 85 being held at a relative rotational position corresponding to the position of the hopper plate 60. The second pivot plate 86 also pivots to the second position while thus engaged with the first pivot plate 85. Regardless of how much paper is loaded, the hopper plate 60 engaged with the first pivot plate 85 can be depressed a specific amount. In other words, regardless of how much paper is loaded, the paper S can be separated from the paper feed roller 15 within a specific angular range of one revolution each time the paper feed roller 15 turns one revolution.

The first pivot plate 85 engages the hopper plate 60 at a position midway along the length of the hopper plate 60 (the direction perpendicular to the axis of rotation) by means of the engaging pin 81. The range of rotation of the first pivot plate 85 on the vertical cassette axis C is therefore smaller than the range of rotation of the hopper plate 60, and the range of rotation of the first external engagement gear 88 formed on the distal end of the first pivot plate 85 is also small. The range of rotation of the second pivot plate 86 having the second external engagement gear 90 that meshes with the first external engagement gear 88 can therefore also be small. As a result, because the component parts require only a small range of movement, the hopper plate moving mechanism 80 can be configured small and compact.

Locking Mechanism

Figure 7B:
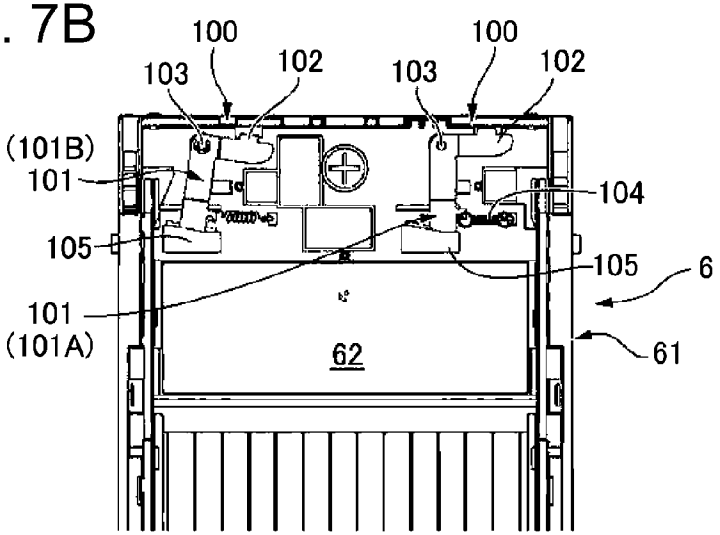
FIG. 7B is a partial plan view.
Figure 7A:
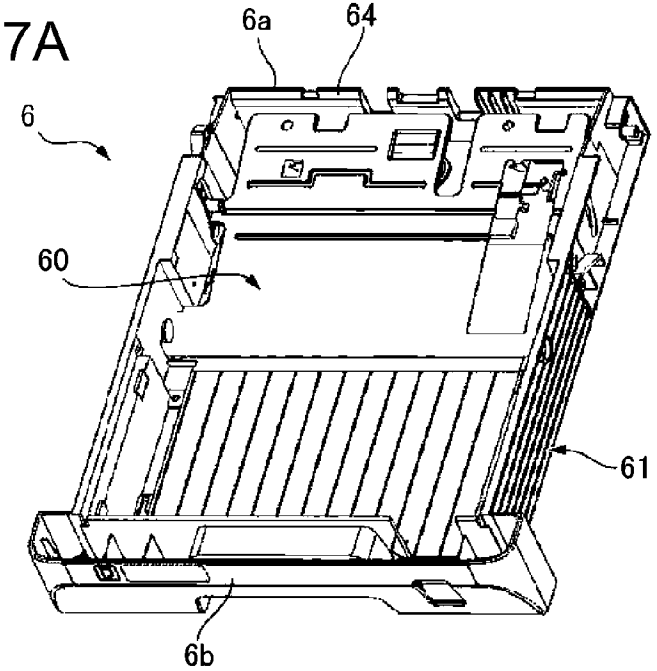
FIG. 7A is an oblique view.
Figure 7C:
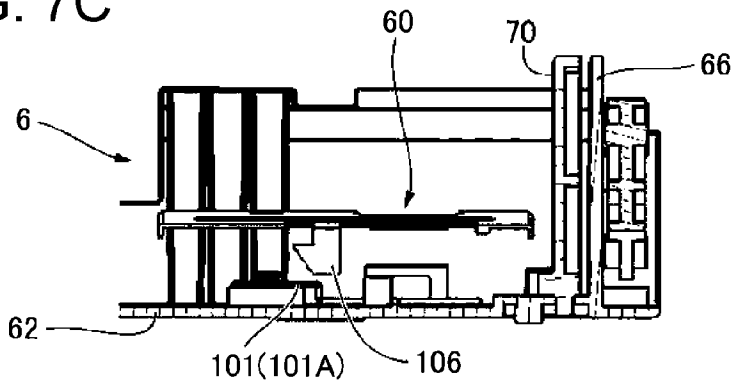
FIG. 7C is a partial section view of the hopper plate locking mechanism.
Figure 8:
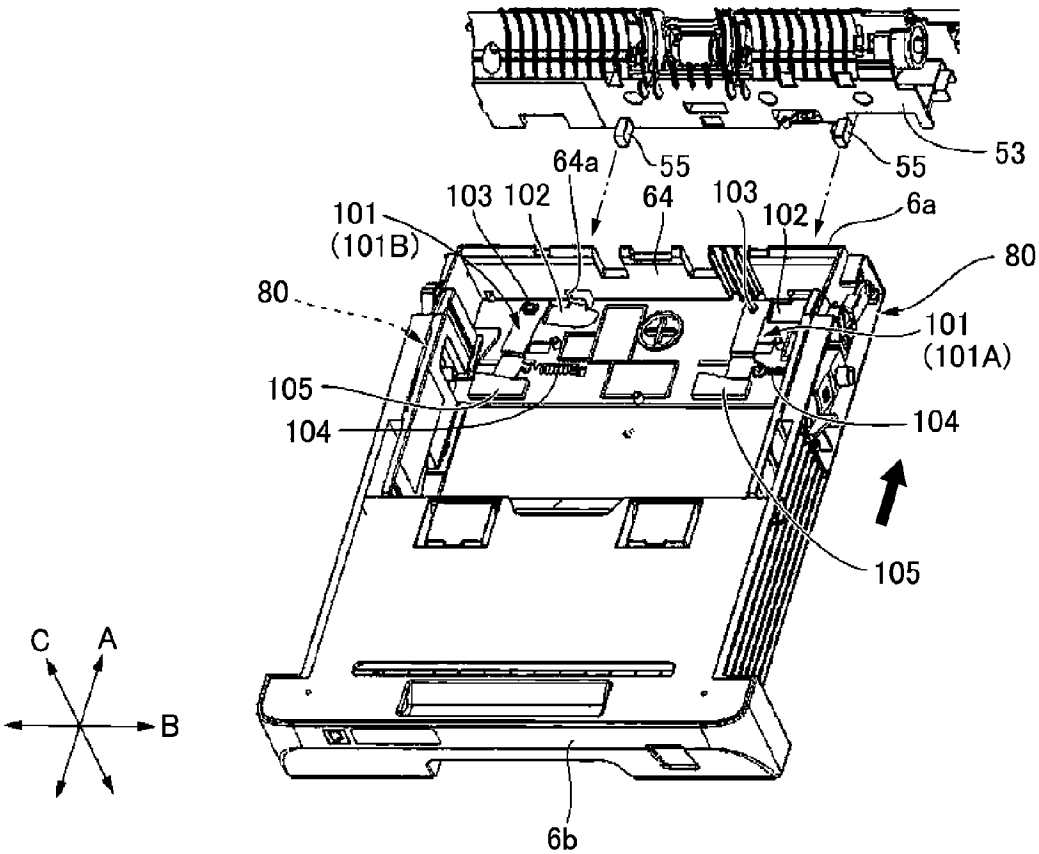
FIG. 8 is a view of the unlocking operation of the locking mechanism.

The locking mechanism 100 that locks the hopper plate 60 is described next with reference to FIG. 7 and FIG. 8. FIG. 7A is an oblique view showing the paper supply cassette with the cover 67 removed, FIG. 7B is a plan view showing part of the paper supply cassette with the hopper plate 60 removed to show the locking mechanism, and FIG. 7C is a section view of the area where the locking mechanism is assembled. FIG. 8 illustrates the unlocking keys 55 of the locking mechanism.

A locking mechanism 100 is disposed on each side on the transverse cassette axis B between the bottom panel 62 and the hopper plate 60 of the paper cassette 6. Both locking mechanisms 100 are configured identically, one of the locking mechanisms 100 is described below, and the same reference numerals are used to refer to the same parts of the other locking mechanism.

The locking mechanism 100 has a cassette-side lever 101 disposed to a specific height from the top at the back wall 64 side of the bottom panel 62. The cassette-side lever 101 extends on the longitudinal axis A of the paper cassette 6, and has an engaging finger 102 extending on the transverse cassette axis B from the base end. Part of the engaging finger 102 faces an opening 64*a* passing through the back wall 64 of the paper cassette 6 on the longitudinal cassette axis A. The cassette-side lever 101 can pivot along the bottom panel 62 on the transverse cassette axis B on a pin 103 fastened to the bottom panel 62.

A tension spring 104 is mounted between the cassette-side lever 101 and the bottom panel 62. The cassette-side lever 101 is held by the tension spring 104 in a locked position 101A with the front end on the longitudinal cassette axis A against a rotation limiting member 105. FIG. 7B and FIG. 8 show one cassette-side lever 101 in the locked position 101A.

As will be understood from FIG. 7C, the locking mechanism 100 has a hopper-side hook 106 that protrudes toward the bottom panel 62 from the back of the hopper plate 60. When the hopper plate 60 is pushed toward the bottom panel 62, the hopper-side hook 106 causes the cassette-side lever 101 to pivot from the locked position 101A to the unlocked position 101B in resistance to the force of the tension spring 104. FIG. 7B and FIG. 8 show one of the cassette-side levers 101 when rotated to the unlocked position 101B. When the hopper-side hook 106 is pushed down to the bottom panel 62 side of the cassette-side lever 101, the force of the tension spring 104 returns the cassette-side lever 101 to the locked position 101A. As a result, the hopper-side hook 106 engages the cassette-side lever 101 and the hopper plate 60 is locked in the locked position.

The locked position of the hopper plate 60 held by the locking mechanism 100 is set to a position closer to the bottom panel 62 than the position of the hopper plate 60 when depressed to the lowest position by the first pivot plate 85 of the hopper plate moving mechanism 80. The hopper plate 60 will therefore not be locked by the locking mechanism 100 when the hopper plate 60 is moved by the hopper plate moving mechanism 80.

The hopper plate 60 is locked by the locking mechanism 100 in conjunction with the operation of pulling the paper cassette 6 out from the paper cassette loading unit 5. As described above, a cam rail 54 is formed on the cassette guides 52 on opposite sides of the paper cassette loading unit 5, and the cam rails 54 are engaged from below by the outside ends of the corresponding engaging pins 81.

As shown in FIG. 4, the bottom guide surface of the cam rail 54 has, in order from the inside end in the insertion direction (the back end on the longitudinal cassette axis A), an incline 54*a* that slopes down, a horizontal surface 54*b* extending substantially horizontally, and an incline 54*c* that slopes up again. When the paper cassette 6 is pulled out from the paper cassette loading unit 5, the engaging pins 81 engaging the hopper plate 60 slide along the guide surfaces of the cam rail 54. The engaging pins 81, and thereby the hopper plate 60, are therefore pushed down along the downward incline 54*a*.

As a result, the paper S loaded on the hopper plate 60 separates from the paper feed roller 15, and problems such as paper S pressed against the paper feed roller 15 being left against the paper feed roller 15 inside the paper cassette loading unit 5 when the paper cassette 6 is pulled out can be avoided. The hopper plate 60 is depressed to the locking position of the locking mechanism 100 by the incline 54*a*, and the hopper plate 60 is thus locked. Handling the removed paper cassette 6 is easy, and replenishing the paper can be done easily.

The hopper plate 60 is unlocked by the locking mechanism 100 in conjunction with the operation that installs the paper cassette 6 to the paper cassette loading unit 5. As shown in FIG. 8, unlocking keys 55 are disposed to the inside end panel 53 of the paper cassette loading unit 5. When the paper cassette 6 is pushed into the paper cassette loading unit 5, the unlocking keys 55 contact the engaging fingers 102 of the cassette-side levers 101, and the engaging fingers 102 are pushed toward the front of the paper cassette 6. As a result, the cassette-side levers 101 can pivot on the pins 103 to the unlocked position 101B in resistance to the spring force. Because the hopper-side hook 106 thus separates from the cassette-side lever 101, the hopper plate 60 is pushed in the direction away from the bottom panel 62 by the force of the spring 71. The hopper plate 60 is thus unlocked from the locking mechanism 100.

Initialization Operation of the Hopper Plate Moving Mechanism

Figure 9B:
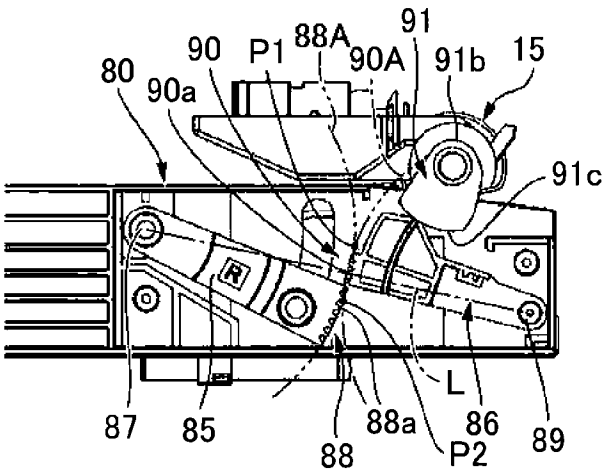
FIGS. 9A and 9B are views of the operation of the hopper plate moving mechanism.
Figure 9A:
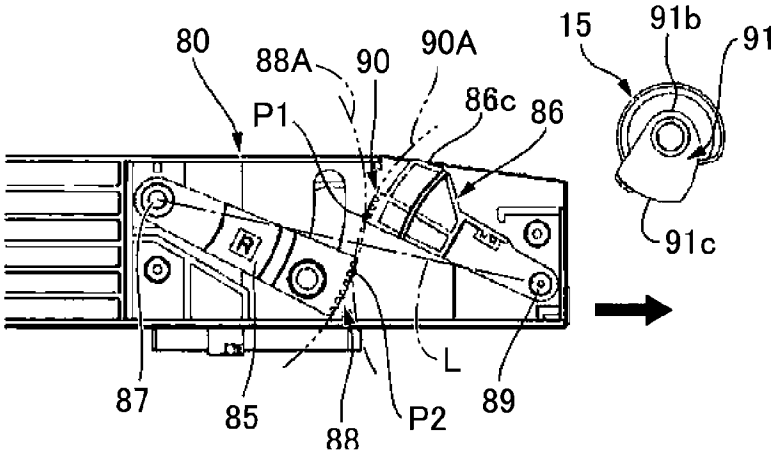

FIG. 9A shows the state of the hopper plate moving mechanism 80 of the paper cassette 6 immediately before being installed to the paper cassette loading unit 5, and FIG. 9B shows when the paper cassette 6 is installed in the paper cassette loading unit 5 and the hopper plate 60 has been unlocked.

The standby rotational position of the paper feed roller 15 disposed on the paper cassette loading unit 5 side is shown in FIG. 9A. In the standby rotational position, the separation cam surface portion 91*c* of the cam surface of the cam plate 91 is facing down. As shown in FIG. 9B, the cam follower 86*c* of the second pivot plate 86 of the hopper plate moving mechanism 80 of the installed paper cassette 6 contacts the separation cam surface portion 91*c*, and is set to the second position.

The locking mechanism 100 is unlocked at or approximately the same time as the second pivot plate 86 engages the cam plate 91. As a result, the first pivot plate 85 in the locked position at the closest position to the bottom panel 62 is free to move with the hopper plate 60 in the direction away from the bottom panel 62 by means of the force of the spring 71. However, the second external engagement gear 90 of the second pivot plate 86 is positioned above the first external engagement gear 88 of the first pivot plate 85. As a result, when the lower first pivot plate 85 tries to move up, it contacts the second pivot plate 86 and cannot move up.

In the state shown in FIG. 9B, the paper S loaded on the hopper plate 60 cannot be positively pressed against the paper feed roller 15. As a result, the paper S supply operation will not start immediately when the paper feed roller 15 turns. When the paper feed roller 15 starts turning and the separation cam surface portion 91*c* of the cam plate 91 moves past the cam follower 86*c* of the second pivot plate 86, the second pivot plate 86 is pushed up to the top first position. As a result, the first pivot plate 85 and hopper plate 60 move up, the paper S is pressed positively against the paper feed roller 15 (see FIG. 6A and FIG. 6C), and the paper supply operation starts.

In the paper supply operation of the first sheet of paper S after the paper cassette 6 is installed, the paper feed roller 15 turns freely until it rotates a specific angle from the standby rotational position, and the paper supply operation of the paper S is not performed. As a result, paper feed problems can occur due to insufficient conveyance of the paper S.

A paper detector that detects if there is any paper S in the installed paper cassette 6 is generally disposed to the paper cassette loading unit 5. The paper detector detects whether or not paper S is on the hopper plate 60 when the hopper plate 60 is pushed up to the up position. If the hopper plate 60 does not move up from the bottom panel 62 side, the paper S on the hopper plate 60 will not be in the detection range of the paper detector. As a result, the paper detector may return a false No Paper result even when paper S is on the hopper plate 60.

To release the first pivot plate 85 from the stuck condition shown in FIG. 9B, the printer 1 according to this embodiment turns the paper feed roller 15 a specific angle in the paper supply direction or the reverse direction to disengage the first and second pivot plates 85, 86, and allow the hopper plate 60 to rise when a command involving the paper supply operation is received. The paper feed roller 15 then turns the same angle in the opposite direction and returns to the standby rotational position. This operation is executed at least before the first paper supply operation after the paper cassette 6 is installed.

Figure 10B:
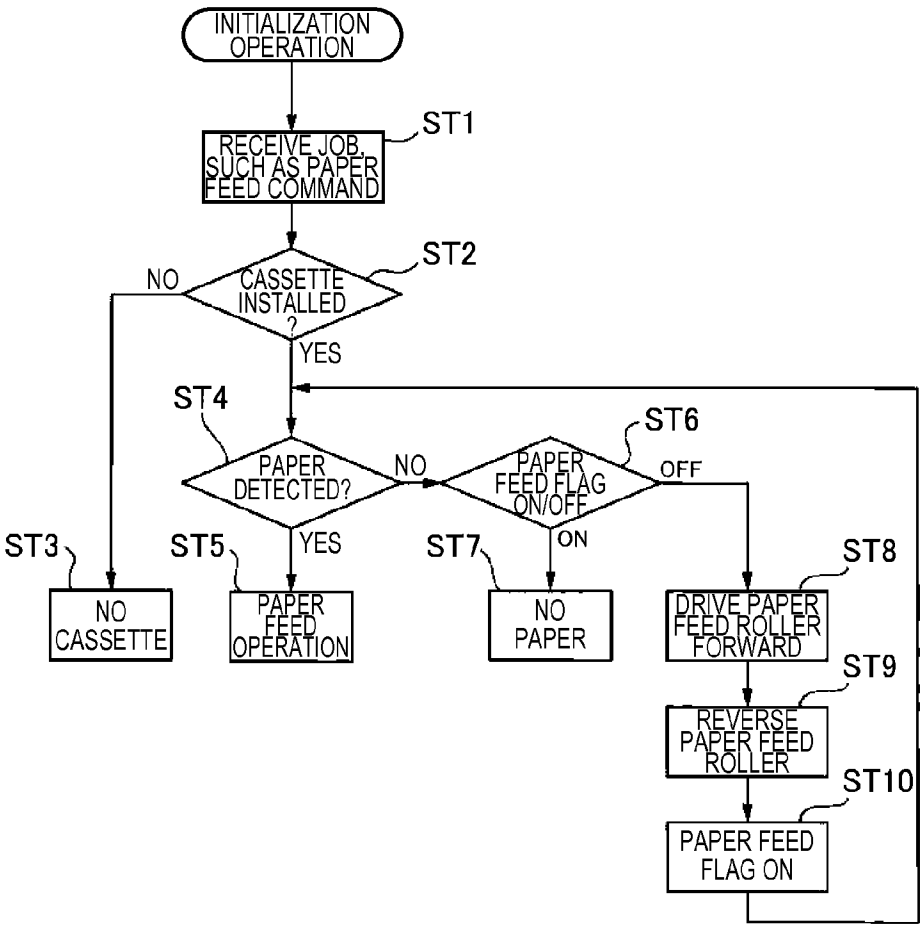
FIG. 10A is a basic block diagram of the printer control system and FIG. 10B is a flow chart of the initialization operation.
Figure 10A:
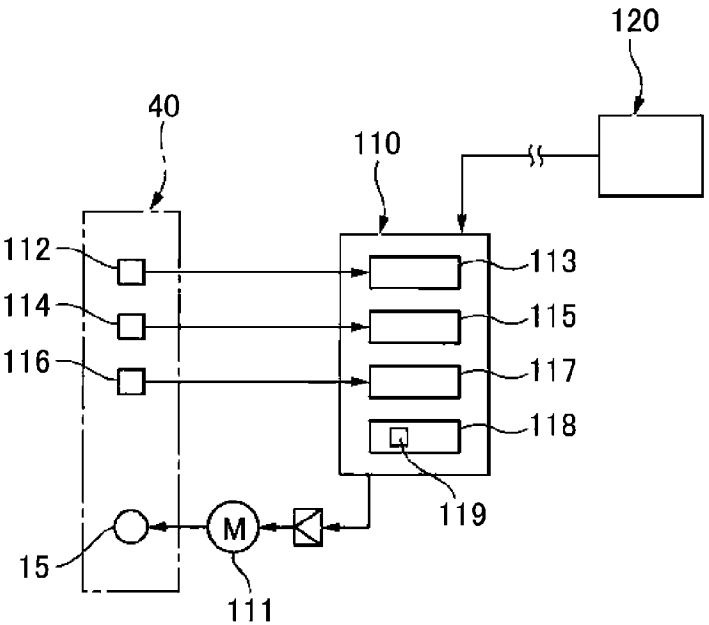

FIG. 10A is a basic block diagram showing the printer control system that controls the initialization operation of the hopper plate moving mechanism 80 to avoid the foregoing problem, and FIG. 10B is a flow chart illustrating steps in the initialization operation.

As shown in FIG. 10A, the control system that controls the hopper plate moving mechanism 80 is configured around a printer control unit 110 that controls operation of the printer 1. When a command accompanying a paper supply operation is received from a host computer 120, for example, the printer control unit 110 controls driving a paper supply motor 111 that turns the paper feed roller 15 of the paper supply device 40 to execute the paper supply operation. The printer control unit 110 controls operation of the hopper plate moving mechanism 80 by executing a previously installed control program.

The printer control unit 110 includes an initialization unit 113 that executes the initialization operation of the hopper plate moving mechanism 80 based on output from a position detector 112 that detects the rotational position of the cam plate 91, a cassette detection unit 115 that determines whether or not a paper cassette 6 is installed in the paper cassette loading unit 5 based on output from a cassette detector 114, and a paper detector 117 that determines whether or not there is paper S in the paper cassette 6 based on an output from a paper detector 116.

A storage area for a paper supply flag 119 is provided in internal memory 118 of the printer control unit 110. The paper supply flag 119 is initialized to OFF by default, turns ON when the initialization operation is performed by the hopper plate moving mechanism 80, and returns to OFF based on output of the cassette detector 114 when the paper cassette 6 is removed.

The initialization operation is described next with reference to the flow chart in FIG. 10B. When an execution command for a job that involves the paper supply operation is received (step ST1) from the host computer 120, for example, the cassette detection unit 115 of the printer control unit 110 first determines whether or not a paper cassette 6 is installed in the paper cassette loading unit 5 based on output from the cassette detector 114 (step ST2). If a paper cassette 6 is not installed, a process such as displaying a NO CASSETTE warning is executed (step ST3).

If a paper cassette 6 is installed, the presence of paper S is determined by the paper detector 117 based on the output of the paper detector 116 (step ST4). If paper is detected, the initialization operation of the hopper plate moving mechanism 80 is not needed, the job is executed, and the paper supply operation is performed (step ST4).

If the paper cassette 6 is installed and No Paper is returned by the paper detector 116, the initialization unit 113 determines the ON/OFF state of the paper supply flag 119 (step ST6). If the paper supply flag 119 is ON, the No Paper detection result is considered valid (step ST7).

If the paper supply flag 119 is OFF, the initialization unit 113 executes the initialization operation, controls driving the paper supply motor ill of the printer conveyance mechanism, drives the paper feed roller 15 to rotate a specific angle forward in the paper supply direction (the direction of arrow CCW in FIG. 6) (step ST8), and then rotates and returns the paper feed roller 15 the same angle in the opposite direction to the standby rotational position (step ST9). Whether or not the cam plate 91 is set to the first position is determined based on the output of the position detector 112 in the initialization operation, and based on this decision the initialization unit 113 controls rotation of the paper feed roller 15. Note that an operation that rotates the paper feed roller 15 a specific angle in reverse, and then rotates and returns the paper feed roller 15 the same angle forward to the standby rotational position is also conceivable, and an operation that rotates the paper feed roller 15 in a single direction is also conceivable.

Next, the paper supply flag 119 is set to the ON state (step ST10). This returns control to the paper detection step of step ST4 after the initialization operation is completed.

The printer control unit 110 thus executes the initialization operation before starting the paper supply operation. In the initialization operation, the paper feed roller 15 rotates from the standby rotational position, and the cam plate 91 rotates the second pivot plate 86 to a first position not interfering with rotation of the first pivot plate 85 engaged with the hopper plate 60. As a result, the hopper plate 60 is pushed up on the vertical cassette axis C by the force of the spring 71, and the paper S is pressed against the paper feed roller 15. As a result, paper S feed problems can be avoided, and the hopper plate 60 is pushed up and the paper S loaded on the hopper plate 60 moves into the detection range of the paper detector 116. Detection errors by the paper detector 116 can therefore be avoided.

Other Examples of the Initialization Operation

Instead of rotating the paper feed roller 15 to release the first pivot plate 85 from the stuck position when the paper cassette 6 is installed as described above, an operation that uses the cam rails 54 of the paper cassette loading unit 5 is also conceivable. More specifically, as shown in FIG. 9A, the second pivot plate 86 is in the raised first position and the second external engagement gear 90 thereof is at a position above the start-meshing position P1, before the paper cassette 6 is installed. Even if the first pivot plate 85 moves up from this position, it will not mesh with the second pivot plate 86.

Installation cam rails that guide the engaging pin 81 when installing the paper cassette are therefore added as the cam rails 54 of the paper cassette loading unit 5. These installation cam rails push the first pivot plate 85 up before the second pivot plate 86 contacts the cam plate 91 when the paper cassette 6 is installed to the paper cassette loading unit 5. At or approximately the same time as the second pivot plate 86 contacts the cam plate 91, the engaging pin 81 of the first pivot plate 85 separates from the installation cam rail.

Thus comprised, when the paper cassette 6 is installed to the paper cassette loading unit 5, the first pivot plate 85 does not engage the second pivot plate 86 that was pushed down to the second position by the cam plate 91. When the hopper plate 60 is unlocked and released, the hopper plate 60 moves up, and the first pivot plate 85 separates from the installation cam rail, moves down by its own weight, and returns to resting on the hopper plate 60.

A sheet feeding device according to one embodiment has a paper feed roller, a sheet support member that supports the sheet supplied by the paper feed roller, and a moving mechanism that moves the sheet support member in a separation direction away from the paper feed roller according to rotation of the paper feed roller. The moving mechanism includes a first moving member that is held in a position corresponding to the number of sheets supported by the sheet support member, and when moving in a specific direction, the moving member can move the sheet support member in the separation direction. The embodiment also includes a second moving member that moves out and back through a specific range of movement during each revolution of the paper feed roller, engages the first moving member, moves the first moving member in a specific direction when moving out, and releases the engagement when moving back.

The moving mechanism of the sheet feeding device according to some embodiments has a first moving member that is held in a position corresponding to the number of sheets supported by the sheet support member, and moves this first moving member using a second moving member. The second moving member moves according to rotation of the paper feed roller. Because the position where the second moving member engages the first moving member changes according to the number of sheets, the amount that the second moving member moves the first moving member changes according to the number of sheets. Therefore, movement of the sheet media that moves in the separation direction changes according to the number of sheets. If the sheet support member moves in the separation direction, the sheets supported on the sheet support member can be reliably separated from the paper feed roller.

If the range of movement of the first moving member is less than the range of movement of the sheet support member, the range of movement of the second moving member can also be reduced. As a result, using two moving members that move within a confined range, a mechanism that separates the sheets supported on a sheet support member from the paper feed roller can be configured small and compact, and can be assembled in a narrow installation space.

In another embodiment, the first moving member is a first rotating member that can rotate on a first support pin. The first moving member engages the sheet support member, and is held in a relative rotational position corresponding to the movement position of the sheet support member. The second moving member is a second rotating member that moves bidirectionally between a first position and a second position on a second support pin in each revolution of the paper feed roller. The relative rotational position of the first rotating member is a position where the first rotating member can engage the second rotating member, and the first rotating member moves the sheet support member in the separation direction.

The above configuration can reliably separate the sheet support member from the paper feed roller by using two rotating parts. Compared with other devices that the inventors are aware of in the art which make use of rotating parts and sliding parts, the above embodiment enables easy construction of a mechanism that moves the sheet support member using relatively fewer parts.

The above-mentioned configuration engages the first rotating member with the sheet support member to rotate in conjunction with the movement of the sheet support member. For example, when the sheet support member pivots on a specific pivot point, if the position where the first rotating member engages the sheet support member is set close to the pivot point of the sheet support member, the range of rotation of the first rotating member can be reduced relative to the range of rotation of the sheet support member. The range of rotation of the second rotating member that engages the first rotating member can therefore also be reduced. Therefore, because the ranges of rotation of the first and second rotating members can be narrow, the mechanism for moving the sheet support member can be configured to be compact and require relatively little space.

In another embodiment, the first rotating member has a first engaging part, the second rotating member has a second engaging part that can engage the first engaging part of the first rotating member, and the first and second engaging parts are formed so that when the second rotating member rotates from the first position to the second position, the second engaging part engages the first engaging part, and when the second rotating member rotates from the second position to the first position, the second engaging part separates from the first engaging part.

In some embodiments, the first engaging part is a first external engagement gear, and the second engaging part is a second external engagement gear that can mesh with the first external engagement gear.

By setting the ranges of the teeth of the first and second external engagement gears, the second external engagement gear can mesh with the first external engagement gear of the first rotating member when the second rotating member pivots from the first position toward the second position, even if the position of the first external engagement gear varies. The gears can also remain engaged until the second rotating member reaches the second position.

In some embodiments, an external gear having a plurality of first external teeth formed at a specific pitch through a specific angular range on a curved surface centered on the first support pin is used as the first external engagement gear, and an external gear having one second external tooth, or having a plurality of second external teeth formed at a specific pitch through a specific angular range on a curved surface centered on the second support pin, is used as the second external engagement gear. The angular range through which the first external teeth are formed is set so that one of the first external teeth on the first external engagement gear is positioned in the range of intersection between the addendum circle of the first external teeth and the addendum circle of the second external teeth.

This configuration reduces the rotation of the second rotating member (the rotation from the first position to the second position) required to engage the first rotating member and rotate the first rotating member a specific amount. As a result, installing the second rotating member requires relatively little space, and the device can be rendered small and compact.

In some embodiments, the weight of the first rotating member causes it to engage the sheet support member from the paper feed roller side. Thus comprised, the engaging structure of the first rotating member that is held in a position relative to the movement of the sheet support member and can move the sheet support member in the separation direction can be easily configured by a simple mechanism using an engagement pin or similar member.

In some embodiments, a sheet feeding device according to at least one embodiment also has a cam that converts rotation of the paper feed roller to rotation of the second rotating member.

By adjusting the cam surface of the cam, the operation that rotates the second rotating member according to rotation of the paper feed roller can be achieved.

In some embodiments, the sheet feeding device thus provides a moving mechanism that can move a sheet support member in the direction away from the paper feed roller by means of a simple, compact construction using two rotating members. Therefore, the moving mechanism can be easily assembled without requiring a large installation space at a position at the axial end of the paper feed roller.

In some embodiments, the cam, the first rotating member, and the second rotating member are disposed to the sheet support member on one side in the direction of the axis of rotation of the paper feed roller, and the cam is attached to the paper feed roller, with the first rotating member and second rotating member disposed along the paper feed direction of the paper feed roller in mutual opposition from the upstream and downstream sides in the paper feed direction. The first rotating member has the first external engagement gear on the end closest to the second rotating member in the paper feed direction, and has the first support pin at the far end, and the second rotating member has the second external engagement gear on the end closest to the first rotating member in the paper feed direction, with the second support pin at the far end.

In a sheet feeding device such as a paper supply device, a cassette-type sheet storage unit may be used so that sheets can be easily added. In this event, the sheet feeding device according to at least one embodiment has a sheet storage cassette having the sheet support member, and a cassette loading unit to which the sheet storage cassette can be removably installed. The first rotating member and second rotating member are attached to the sheet storage cassette, and the paper feed roller is disposed to the cassette loading unit.

If the sheets remain pressed against the paper feed roller by the sheet support member when a sheet storage cassette is used and the sheet storage cassette is removed from the cassette loading unit, the sheet storage cassette may be removed with the sheet pressed against the paper feed roller left inside the cassette loading unit.

In some embodiments, the sheet storage cassette has a locking mechanism that can lock the sheet support member when the sheet support member moves in the separation direction toward a locking position, and the cassette loading unit has a loading unit-side engaging part that engages the first rotating member of the sheet storage cassette pulled out from the cassette loading unit, and rotates the first rotating member until the sheet support member moves to the locking position.

When the sheet storage cassette is pulled out from the cassette loading unit, the sheet support member engages the loading unit-side engaging part, is forcibly moved in the direction away from the paper feed roller, and is locked by the locking mechanism. As a result, because the sheets in the sheet storage cassette separate from the paper feed roller, removing the sheet storage cassette while leaving one or more sheets in the cassette loading unit can be avoided.

When the sheet storage cassette is again installed in the cassette loading unit, the sheets held on the sheet support member cannot be returned to the position pressed against the paper feed roller on the cassette loading unit side if the locking mechanism is not released. As a result, the cassette loading unit in the sheet feeding device according to some embodiments has an unlocking unit that engages the locking mechanism of the installed sheet storage cassette, and releases the sheet support member from the locking mechanism.

Because the lock is disengaged by installing the sheet storage cassette, there is no need to manually disengage the lock when installing the sheet storage cassette. The user forgetting to unlock the lock can also be avoided.

In addition to the moving mechanism described above, the sheet feeding device in some embodiments also has a cam that converts rotation of the paper feed roller to rotation of the second rotating member, and a control unit that controls the sheet feeding operation of the paper feed roller. The control unit has an initialization unit that executes an initialization operation to rotate the paper feed roller so that the second rotating member rotates to the first position before the sheet feeding operation starts.

When the second rotating member is rotated to the second position, the first rotating member may be at a position on the opposite side as the first position. In this event, the first rotating member engages the second rotating member when rotating in the direction toward the second rotating member side, and rotation of the first rotating member is obstructed. Because the first rotating member engages the sheet support member, the sheet support member cannot move toward the paper feed roller if the first rotating member cannot turn. The sheets supported on the sheet support member can therefore not be set to the position pressed against the paper feed roller.

Sheets cannot be fed in this condition even if the paper feed roller turns. If the paper feed roller turns and the first rotating member returns from the second position to the first position, the first rotating member can turn, and the first rotating member and sheet support member move in the direction toward the paper feed roller by the pressure from a pressure member. As a result, the sheets supported on the sheet support member are pressed against the paper feed roller, and the sheet feeding operation can then start.

In this event, sheet feeding does not start simultaneously to rotation of the paper feed roller, and sheet feeding starts from a time after the paper feed roller rotates a specific angle. Problems such as a sheet not being advanced far enough, and the sheet not being passed to the retard roller downstream therefrom in the conveyance direction, can therefore occur.

In the sheet feeding device according to some embodiments, the initialization unit of the control unit executes an initialization operation before the sheet feeding operation starts. This operation returns the second rotating member to the first position not engaged with the first rotating member. As a result, when the sheet feeding operation starts, the sheet support member moves to the paper feed roller side, and the sheets are pressed against the paper feed roller. Sheets can therefore be fed reliably from the time rotation of the paper feed roller starts.

To constantly advance sheets a specific amount in the sheet feeding device according to some embodiments, after the second rotating member rotates to the first position in the initialization operation, the initialization unit rotates the paper feed roller to a standby rotational position and positions the second rotating member to the second position.

So that sheets can be easily added, the sheet feeding device according to some embodiments has a sheet storage cassette and a cassette loading unit to which the sheet storage cassette can be removably installed. The sheet support member, the first rotating member, and the second rotating member are disposed to the sheet storage cassette, and the paper feed roller and the cam are disposed to the cassette loading unit.

According to at least one embodiment, the control unit executes the initialization operation by the initialization unit if the sheet storage cassette is installed in the cassette loading unit. For example, if the control unit has a cassette detection unit that determines whether or not the sheet storage cassette is installed in the cassette loading unit, the initialization unit executes the initialization operation when the sheet storage cassette has been installed.

According to at least one embodiment, when the sheet storage cassette is installed and a sheet is not stored in the sheet storage cassette, the control unit executes the initialization operation by the initialization unit. For example, when the control unit has a sheet detection unit that determines if a sheet is stored in the sheet storage cassette when the sheet storage cassette is installed, the initialization unit executes the initialization operation when the sheet detection unit determines a sheet is not stored.

When the first rotating member engaged with the sheet support member cannot rotate, the sheet support member may not be able to move into the detection range of the detector that detects is there is a sheet supported on the sheet support member. Therefore, the detector output remains in the state when a sheet is not present. Therefore, the first rotating member being unable to rotate can result in falsely detecting a sheet is not present (No Paper). When a sheet is not stored, for example, when it is determined that a sheet is not stored, the initialization operation therefore executes to avoid detection errors.

So that the initialization operation does not execute needlessly, the control unit in at least one embodiment has a storage unit that indicates if the initialization operation executed. When the storage unit indicates the initialization operation has not executed, such as when a sheet is not stored or it is determined that a sheet is not stored, the initialization operation executes.

In a sheet feeding device according to some embodiments, the initialization unit positions the paper feed roller to a standby rotational position, and positions the second rotating member to the second position, in the standby mode.

By positioning the second rotating member to the second position, the sheets in the sheet storage cassette are separated from the paper feed roller. Therefore, problems such as sheets pressed against the paper feed roller being left in the cassette loading unit after the sheet storage cassette is pulled out of the cassette loading unit can be prevented. The sheets in the sheet storage cassette contact the paper feed roller when the sheet storage cassette is installed in the cassette loading unit, and problems such as sheets being damaged or wrinkled, for example, can be prevented.

In a sheet feeding device according to some embodiments, the initialization unit executes the initialization operation based on the position of the cam. The rotational angle position of the paper feed roller, and the rotational position of the second rotating member, can be precisely controlled based on the position of the cam. As a result, the operation that moves the sheet support member toward and away from the paper feed roller can be executed precisely.

Some embodiments include a printer having a paper supply device, and a printhead that prints on recording media supplied from the paper supply device.

What is claimed is:

1. A sheet feeding device, comprising:

a paper feed roller;

a sheet support member configured to support a number of sheets of recording media supplied by the paper feed roller;

a sheet storage cassette having the sheet support member;

a cassette loading unit to which the sheet storage cassette is configured to be removably installed; and a moving mechanism configured to move the sheet support member in a separation direction away from the paper feed roller according to rotation of the paper feed roller, the moving mechanism comprising:

a first moving member configured to be held in a position corresponding to the number of sheets supported by the sheet support member, and upon moving in a specific direction, move the sheet support member in the separation direction, and a second moving member configured to move out and back through a specific range of movement in each revolution of the paper feed roller, and engage the first moving member and move the first moving member in the specific direction upon moving out, and release said engagement upon moving back wherein:

the first moving member is a first rotating member configured to rotate on a first support pin, engage the sheet support member, and be held in a relative rotational position corresponding to a movement position of the sheet support member, the second moving member is a second rotating member configured to move bidirectionally between a first position and a second position on a second support pin for each revolution of the paper feed roller, the relative rotational position of the first rotating member is such that the first rotating member is configured to engage the second rotating member upon the second rotating member rotating from the first position to the second position, the first rotating member is configured to be engaged with the second rotating member and rotated by the second rotating member, upon the second rotating member rotating toward the second position, to move the sheet support member in the separation direction, the first rotating member and second rotating member are each attached to the sheet storage cassette, the paper feed roller is disposed to the cassette loading unit, the sheet storage cassette has a locking mechanism configured to lock the sheet support member upon the sheet support member moving in the separation direction to a locking position; and the cassette loading unit further comprises a loading unit-side engaging part configured to engage the first rotating member of the sheet storage cassette upon the sheet storage cassette being pulled out from the cassette loading unit, and rotate the first rotating member until the sheet support member moves to the locking position.

2. The sheet feeding device described in claim 1, wherein:

the cassette loading unit has an unlocking unit configured to engage the locking mechanism of the installed sheet storage cassette, and release the sheet support member from the locking mechanism.

3. The sheet feeding device described in claim 1, further comprising:

a cam configured to convert rotation of the paper feed roller to rotation of the second rotating member; and a control unit configured to control a sheet feeding operation of the paper feed roller;

the control unit having an initialization unit configured to execute an initialization operation to rotate the paper feed roller such that the second rotating member rotates to the first position before the sheet feeding operation starts.

4. The sheet feeding device described in claim 3, wherein:

after the second rotating member rotates to the first position in the initialization operation, the initialization unit is configured to rotate the paper feed roller to a standby rotational position and position the second rotating member to the second position.

5. The sheet feeding device described in claim 3, further comprising:

a sheet storage cassette; and a cassette loading unit to which the sheet storage cassette is configured to be removably installed;

wherein the sheet support member, the first rotating member, and the second rotating member are attached to the sheet storage cassette, the paper feed roller and the cam are disposed to the cassette loading unit, and the control unit is configured to execute the initialization operation by the initialization unit when the sheet storage cassette is installed in the cassette loading unit.

6. The sheet feeding device described in claim 5, wherein:

when the sheet storage cassette is installed and a sheet is not stored in the sheet storage cassette, the control unit is configured to execute the initialization operation by the initialization unit.

7. The sheet feeding device described in claim 6, wherein:

the control unit has a storage unit configured to indicate when the initialization operation has been executed; and the initialization unit is configured to execute the initialization operation when the storage unit indicates the initialization operation has not executed when a sheet is not stored.

8. The sheet feeding device described in claim 5, wherein:

the initialization unit is configured to position the paper feed roller to a standby rotational position, and position the second rotating member to the second position, in a standby mode.

9. The sheet feeding device described in claim 3, wherein:

the initialization unit is configured to execute the initialization operation based on the position of the cam.

* * * * *